US007268745B2

(12) United States Patent
Yang et al.

(10) Patent No.: US 7,268,745 B2
(45) Date of Patent: Sep. 11, 2007

(54) COAXIAL CABLE FREE QUADRI-FILAR HELICAL ANTENNA STRUCTURE

(75) Inventors: Pei-Lin Yang, Hsinchu (TW); Chia-Chun Hung, Hsinchu (TW)

(73) Assignee: Jabil Circuit Taiwan Limited, Hsinchu (TW)

( * ) Notice: Subject to any disclaimer, the term of this patent is extended or adjusted under 35 U.S.C. 154(b) by 19 days.

(21) Appl. No.: 11/274,418

(22) Filed: Nov. 16, 2005

(65) Prior Publication Data

US 2007/0013606 A1 Jan. 18, 2007

(30) Foreign Application Priority Data

Jul. 13, 2005 (TW) ..... 94123696 A

(51) Int. Cl.
*H01Q 1/36* (2006.01)

(52) U.S. Cl. ..... 343/895; 343/702

(58) Field of Classification Search ..... 343/895, 343/702, 860

See application file for complete search history.

(56) References Cited

U.S. PATENT DOCUMENTS 6,072,441 A * 6/2000 Tanabe ..... 343/895
6,369,776 B1 * 4/2002 Leisten et al. ..... 343/895
6,426,316 B2 * 7/2002 Tanaka et al. ..... 502/340
6,552,693 B1 * 4/2003 Leisten ..... 343/895
2006/0022891 A1 * 2/2006 O'Neill et al. ..... 343/895
2006/0022892 A1 * 2/2006 O'Neill et al. ..... 343/895

* cited by examiner

*Primary Examiner*—Trinh Vo Dinh
(74) *Attorney, Agent, or Firm*—Bacon & Thomas, PLLC

(57) ABSTRACT

A quadri-filar helical antenna structure includes a cylindrical body having a relative dielectric constant greater than 4, and four radial metal plates on a distal end of the cylindrical body, and each radial metal plate is extended along the cylindrical body. The ends of every two adjacent radial metal plates are connected to form two antenna structures, and a circuit board is fixed. A ground surface is installed on one side of the circuit board and coupled to one of the antennas. An impedance matching circuit is installed on another side of the circuit board, and one end of the impedance matching circuit is coupled to another antenna. A feeder is installed at another end of the impedance matching circuit. Four radial metal plates having an electric length about odd multiples of a quarter of wavelength of the cylindrical body can receive satellite signals.

24 Claims, 9 Drawing Sheets

Point 1:-23.768 dB
1.575819996 GHz

Point 3:-9.9770 dB
1.56607 GHz

Point 4:-10.006 dB
1.58393 GHz

Frequency (GHz)

Point 1: 51.376 Ohms
-6.3574 Ohms
1.57581996 GHz

Point 3: 37.740 Ohms
26.232 Ohms
1.56607 GHz

Point 4: 63.879 Ohms
-35.014 Ohms
1.58393 GHz

Point 1: -24.167 dB
1.575059996 GHz

Point 3: -10.357 dB
1.56533 GHz

Point 4: -10.443 dB
1.58702 GHz

Point 1: 49.918 Ohms
-6.1973 Ohms
1.575059996 GHz

Point 3: 74.035 Ohms
-30.059 Ohms
1.56533 GHz

Point 4: 27.104 Ohms
-3.6650 Ohms
1.58702 GHz

COAXIAL CABLE FREE QUADRI-FILAR HELICAL ANTENNA STRUCTURE

FIELD OF THE INVENTION

The present invention relates to a quadric-filar helical antenna structure, and more particularly to a quadric-filar helical antenna structure free of coaxial cables.

BACKGROUND OF THE INVENTION

Traditionally, an antenna for receiving satellite signals is generally designed as a three-dimensional helical structure, which is a three-dimensional antenna having its radial metal plates extended in a helical course along a coaxial line to define a three-dimensional space. In Great Britain Pat. No. 2,258,776, a three-dimensional antenna structure is disclosed. In that patent, a plurality of radial metal plates is arranged around a coaxial line and extended in a helical course to define a three-dimensional multiple-filar helical antenna structure. Since such three-dimensional antenna has a better capability of receiving circularly polarized signals coming directly from above, therefore this kind of antenna is usually used for a global positioning system (GPS) to receive a coordinates positioning signal from a satellite group. Further, this kind of three-dimensional antenna is suitable to serve as an omni-directional antenna for receiving vertically and horizontally polarized signals. However, the shortcomings of this three-dimensional antenna resides on that its structure is not strong enough for certain applications, and corrections cannot be made easily without affecting its overall performance.

In view of the foregoing shortcomings of the multiple-filar helical antenna, many antennas for receiving satellite signals in poor weathers adopt a patch antenna instead. For example, the antenna installed at the outside of an airplane is a patch antenna which has a radial metal plate attached onto an insulator on an airplane. However, this kind of patch antenna only has a low gain when the airplane is rising at a small angle. To overcoming this drawback, antenna designers install a plurality of patch antennas onto different positions and at different angles of the body of an airplane, so that a feeder end of each patch antenna is connected to the same receiver to receive satellite signals. Since it takes a number of patch antennas to achieve this result and it is difficult to integrate all signals received by the patch antennas, therefore the cost becomes very high.

To solve the foregoing problem, U.S. Pat. Nos. 6,369,776, 6,424,316, and 6,552,693 by Leisten were disclosed, wherein these patents effectively reduce the size of traditional quadri-filar antennas and design a novel quadri-filar antenna structure. Referring to FIG. 1, the antenna has a cylindrical body 12 made of a ceramic material, and four antenna elements 10A, 10B, 10C, 10D disposed on a circumferential surface at an end proximate to the cylindrical body 12 and extended along its axial direction in a helical course, and each antenna element 10A, 10B, 10C, 10D is a metal sheet, and the cylindrical body 12 includes a penetrating hole 14 disposed along the axial direction of the center, and a metallic lining 16 is covered on the internal wall of the penetrating hole 14 and an insulator 17 is installed therein. The insulator 17 at its center installs an axial feeder conductor 18, and the axial feeder conductor 18 and the metallic lining 16 form a feeder structure, such that a feeder line of a signal receiver (not shown in the figure) can be connected to the antenna elements 10A, 10B, 10C, 10D through the feeder structure. The antenna structure further comprises a plurality of radial antenna elements 10AR, 10BR, 10CR, 10DR disposed on a distal surface of the cylindrical body 12, and each radial antenna element 10AR,10BR,10CR, 10DR is also a metal sheet coupled with the corresponding end of the antenna element 10A, 10B, 10C, 10D respectively, such that an end of the antenna element 10A, 10B, 10C, 10D is coupled to the feeder structure respectively, and a common grounding conductor 20 is disposed on the circumferential surface at the other end proximate to the cylindrical body 12, and the common grounding conductor 20 is embedded into the circumferential surface at the other end of the cylindrical body 12, and an end of the common grounding conductor 20 is coupled to another end of the antenna elements 10A, 10B, 10C, 10D, and the other end is extended to the other distal surface of the cylindrical body 12 to form a "Sleeve Balun" coupled to the metallic lining 16. Referring to FIG. 1 for the antenna structure, each antenna element 10A, 10B, 10C, 10D has a different length and a different shape, wherein the two antenna elements 10B, 10D are extended in a meandering course along the circumferential surface 12D of the cylindrical body 12 in a helical form. Therefore, its length is longer than the two antenna elements 10A, 10C in other linear courses extended in a helical course along the circumferential surface of the cylindrical body 12.

From the literature published by Leisten, the quadri-filar antenna uses a ceramic material with a high dielectric constant ($\epsilon_r$=36) as a base, and the four antenna elements 10A, 10B, 10C, 10D have an electric length of half a coil and a half wavelength. Therefore, the size of traditional quadri-filar antennas can be reduced greatly. However, the manufacturing process is more complicated and has to go through the copper plating, exposure, etching and laser trimming processes. Particularly, the height of the Sleeve Balun must be controlled within several micrometers to eliminate unbalanced currents and thus greatly increasing the manufacturing hours, manpower and costs.

Further, manufacturers simplify the foregoing processes by Leisten's patented inventions by designing a coaxial cable precisely embedded into the penetrating hole 14. To meet the required impedance, a metal shielding layer of the metallic lining 16 on the coaxial cable is manufactured according to a particular specification. Therefore, a coaxial cable of a length of several centimeters costs about 3~4 US dollars. Furthermore, for antennas of different specifications and requirements, it is necessary to redesign a different coaxial cable, and thus it is not easy to perform impedance matching and adjustment for antennas, and the manufacturing cost cannot be lowered effectively due to the expensive cost of the coaxial cable.

SUMMARY OF THE INVENTION

In view of the description above, the inventor of the present invention based on years of experience to conduct extensive researches and experiments to overcome the shortcomings of the complicated manufacturing process, high cost, and difficulty of matching impedance, and finally invented a coaxial cable free quadri-filar helical antenna structure. The present invention effectively simplifies the manufacturing process, reduces the time and manpower required for the manufacturing process, and greatly lowers its manufacturing cost to achieve the objectives of designing and adjusting the impedance matching.

An objective of the present invention is to provide a quadri-filar helical antenna structure that comprises a cylindrical body made of a dielectric material having a relative dielectric constant greater than 4, and four radial metal plates disposed on the surface at an end of the cylindrical body, and each radial metal plate is extended along the radial direction of the center of the cylindrical body, and then extended in a helical course on the circumferential surface from an end of its periphery to another end of the periphery. On the distal surface, the ends of every two adjacent radial metal plates are coupled to form two sets of antenna structures, and a circuit board is fixed to a position proximate to the distal end of the circuit board. A ground surface is installed on one side of the circuit board, and the ground surface is coupled to a set of antenna. An impedance matching circuit is installed on another side of the circuit board, and one end of the impedance matching circuit is coupled to another set of the antenna. Another end of the impedance matching circuit is a feeder end of the antenna signal, so as to form an antenna that does not need a "Balun" or embed a coaxial cable at the center position of the cylindrical body. Four radial metal plates having an electric length of odd multiples and about a quarter of wavelength of the cylindrical body achieve the purpose of receiving satellite signals. The present invention not only reduces the manufacturing cost, but also facilitates the design and adjustment of the impedance matching circuit to produce the required antenna.

Another objective of the present invention is to connect the cylindrical body to the circuit board by a connecting element, and the two antennas on the cylindrical body are separately and electrically coupled to the ground surface of the circuit board and the impedance matching circuit, Another objective of the present invention is to build two electric contact points at an end of the connecting element, and the two electric contact points are separately, physically and electrically coupled to two antenna structures disposed on a distal surface of the cylindrical body, and another two electric contact points are built on another end of the connecting element, and these other two electric contact points are separately and electrically coupled to the ground surface and the two corresponding sides of the circuit board. Two corresponding circuits on the connecting element are physically and electrically coupled between the two electric contact points and the other two electric contact points.

Another further objective of the present invention is to built a first and a second fixing structures made of an insulator and disposed on both ends of the connecting element; wherein the first fixing structure is fixed onto an end of the cylindrical body, and the second fixing structure is clamped at an edge of the circuit board, so that the cylindrical body and the circuit board can be securely connected.

DETAILED DESCRIPTION OF THE PREFERRED EMBODIMENTS

Figure 1:
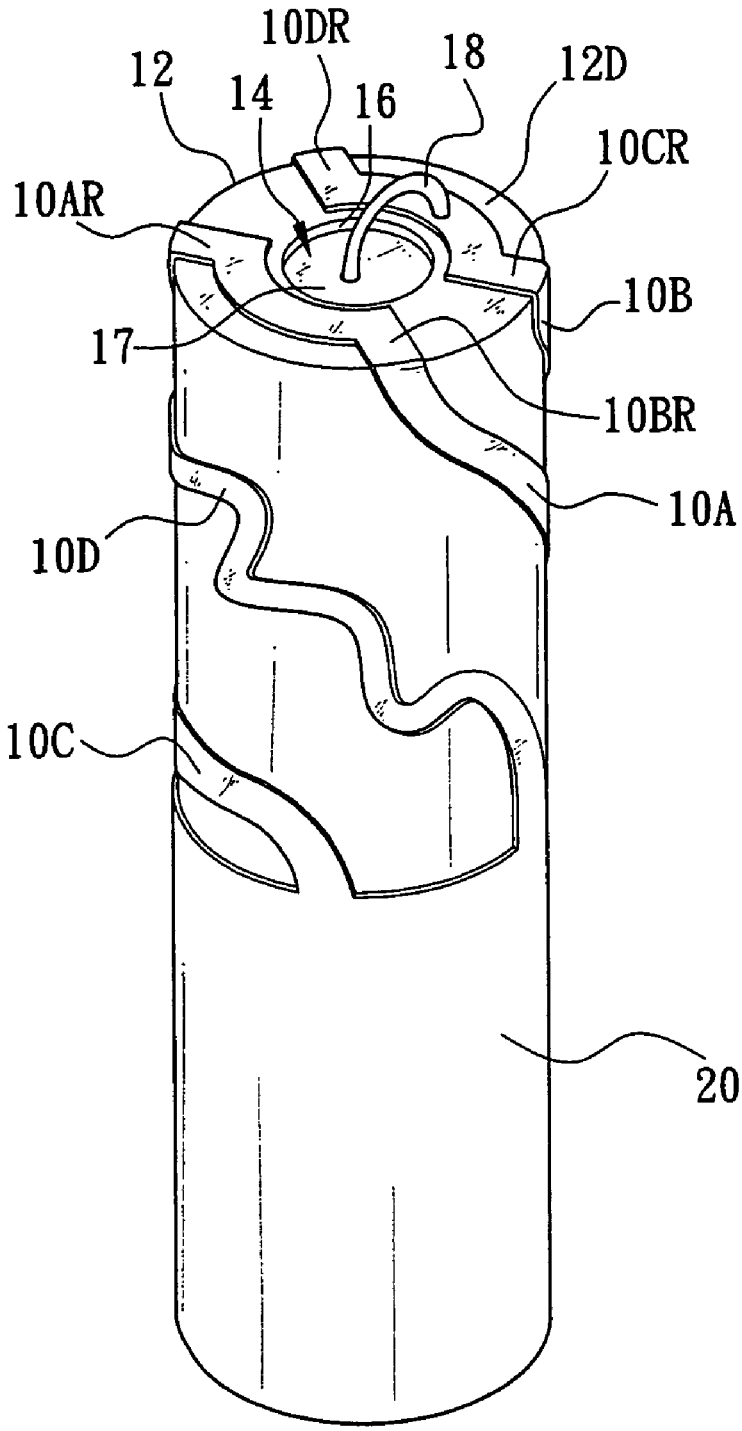
FIG. 1 (Prior Art)
FIG. 1 is a schematic view of an antenna structure according to Leisten's patent.
Figure 2:
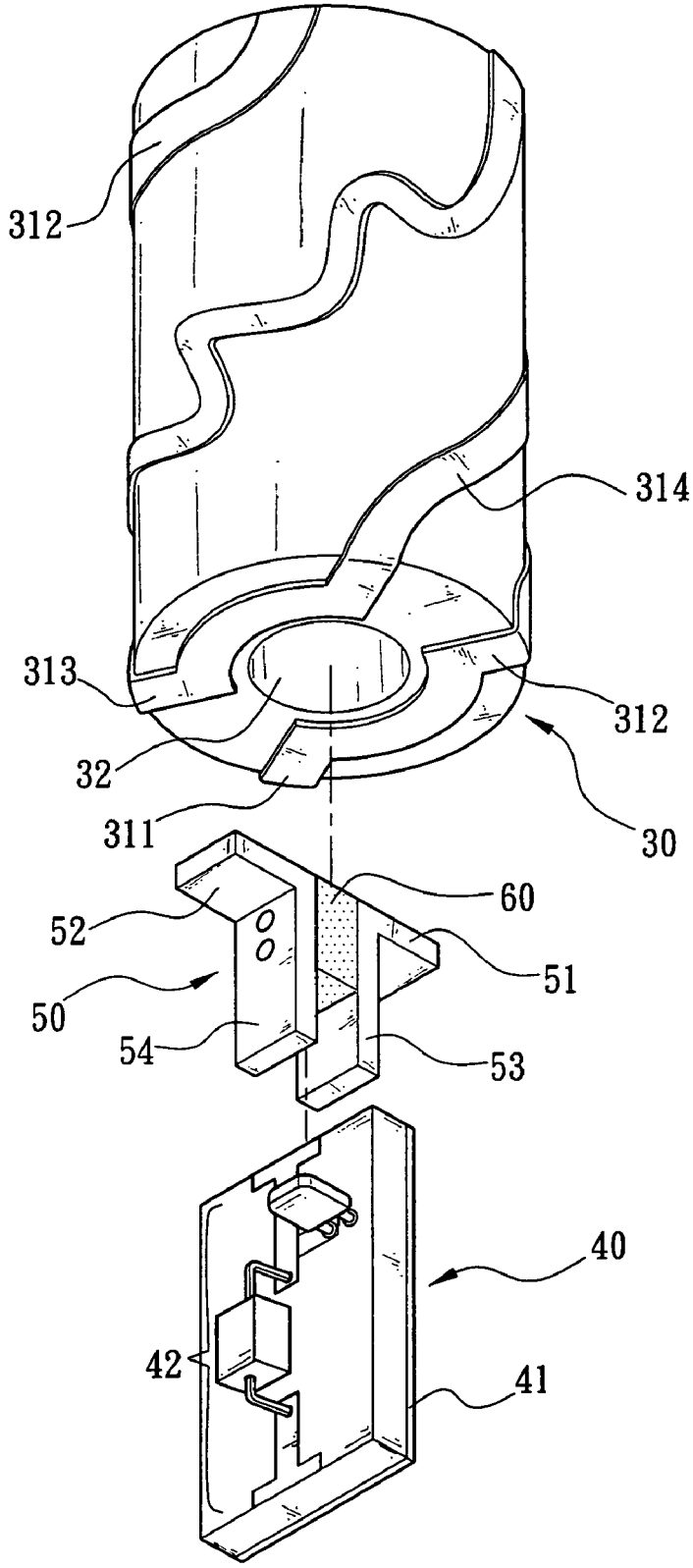
FIG. 2 is a schematic view of a quadri-filar helical antenna structure according to a preferred embodiment of the present invention.
Figure 3:
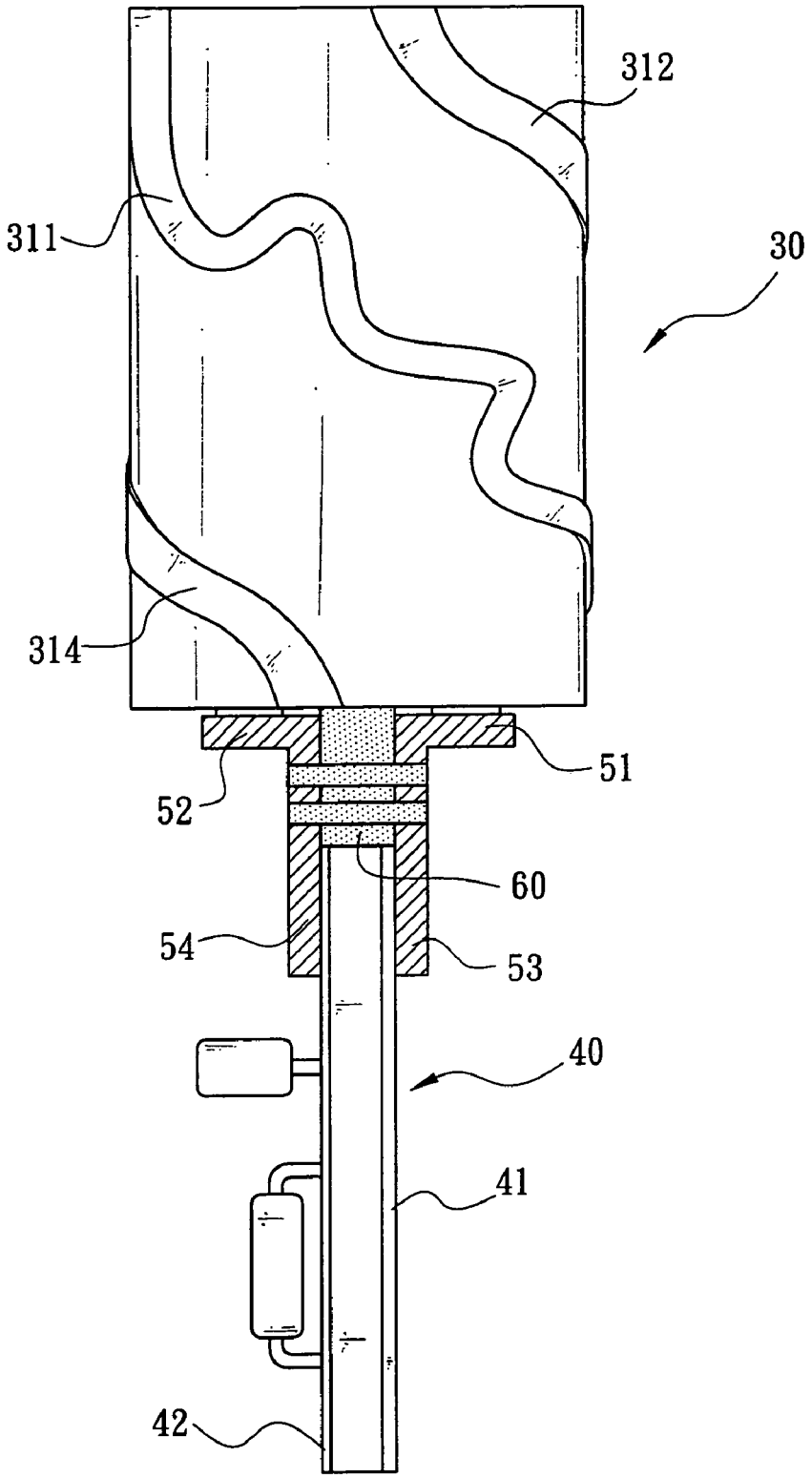
FIG. 3 a cross-sectional view of a quadri-filar helical antenna as depicted in FIG. 2.

Referring to FIGS. 2 and 3, a coaxial cable free quadri-filar helical antenna structure comprises a cylindrical body 30 made of a dielectric material; four radial metal plates 311, 312, 313, 314 disposed on a distal end of the cylindrical body 30, and each radial metal plate 311, 312, 313, 314 is extended along the radial direction from the center of the cylindrical body 30 to its periphery and further to the circumferential surface of the cylindrical body 30 in a helical course along the axial direction to another edge of the cylindrical body 30. Distal surfaces of the cylindrical body 30 at the corresponding ends of every two adjacent radial metal plates 311 and 312, 313 and 314 are connected to form two sets of antenna structures. In the present invention, the dielectric material of the cylindrical body 30 has a relative dielectric constant greater than 4 and could be a ceramic material or other polymer material such as magnesium-silicate and strontium-zirconate compound, magnesium-titanate and calcium-titanate compound, barium-titanate and titanium-dioxide, and tin-oxide compound, barium-titanate, neodymium-titanate and bismuth-titanate compound. The relative dielectric constants of these dielectric materials are approximately 8, 20, 40, 98 respectively, and the lengths of the radial metal plates 311, 312, 313, 314 is equal to an odd multiple of the electric length at a quarter of the wavelength of the resonant frequency of the antenna, which is equal to n ($\lambda g/4$), and n is an odd number (such as 1, 3, 5, . . . ), $\lambda g$ is the wavelength of the resonant frequency of the antenna.

It is worth to point out that there is no ground metal plate built on a distal surface of the cylindrical body 30 according to the present invention. Referring to FIGS. 2 and 3, an opening 32 is disposed at the center position of the cylindrical body 30, but no coaxial cable or similar device is embedded in the opening 32. The main purpose of building the openings 32 is to provide a clamping and holding position for a tool when the radial metal plates 311, 312, 313, 314 are produced on the surface of the cylindrical body 30 to facilitate a printing. The radial metal plates 311, 312, 313, 314 are covered in a helical form onto predetermined positions of the cylindrical body 30. Therefore, the openings 32 of the present invention are not necessary. In other words, if other method is used to cover the radial metal plates 311, 312, 313, 314 onto the predetermined positions of the surface of the cylindrical body 30, then it is not necessary to build the openings 32 at the center position of the cylindrical body 30.

In the present invention, a circuit board 40 is connected to a distal surface proximate to the cylindrical body 30, and a ground surface 41 is disposed on a side of the circuit board 40, and the ground surface 41 is electrically coupled to a set of antenna (which is an antenna formed by the radial metal plates 311, 312), and an impedance matching circuit 42 is built on the other side of the circuit board 40, and the other end of the impedance matching circuit 42 is electrically coupled to another set of antenna (which is an antenna formed by the radial metal plates 313, 314.) Another end of the impedance matching circuit 42 is a signal feeder end of the antenna. Therefore, the antenna so formed does not need a Balun, and it is no necessary to embed a coaxial cable at the center position of the cylindrical body 30. Only four radial metal plates 311, 312, 313, 314 having odd multiples of the electric length of approximately a quarter wavelength of the cylindrical body 30 surround the cylindrical body 30 to achieve the purpose of receiving satellite signals. Such arrangement not only lowers the manufacturing cost greatly, but also facilitates the design and adjustment of the impedance matching circuit 42 to produce the required antenna.

In the present invention, the cylindrical body 30 and the circuit board 40 are securely coupled, and a connecting element 50 is provided for connecting the cylindrical body 30 to the circuit board 40 and also electrically coupling the two antenna structures on the cylindrical body 30 separately to the ground surface 41 and the impedance matching circuit 42 on the circuit board 40. Referring to FIGS. 2 and 3 for the preferred embodiment of the present invention, the connecting element 50 comprises an insulating material 60, two electric contact points 51, 52 disposed at an end of the insulating material 60 and the two electric contact points 51, 52 are soldered to be physically and electrically coupled with the two sets of antennas (which are formed by the radial metal plates 311 and 312, 313 and 314) disposed at a distal surface of the cylindrical body 30. The other end of the insulating material 60 includes another two electric contact points 53, 54 being soldered to physically and electrically couple the ground surface 41 and the impedance matching circuit 42 disposed on two corresponding sides of the circuit board 40: In the connecting element 50, the two electric contact points 51, 52 and the other two electric contact points 53, 54 are electrically coupled by two corresponding independent courses of the connecting element 50.

Figure 4:
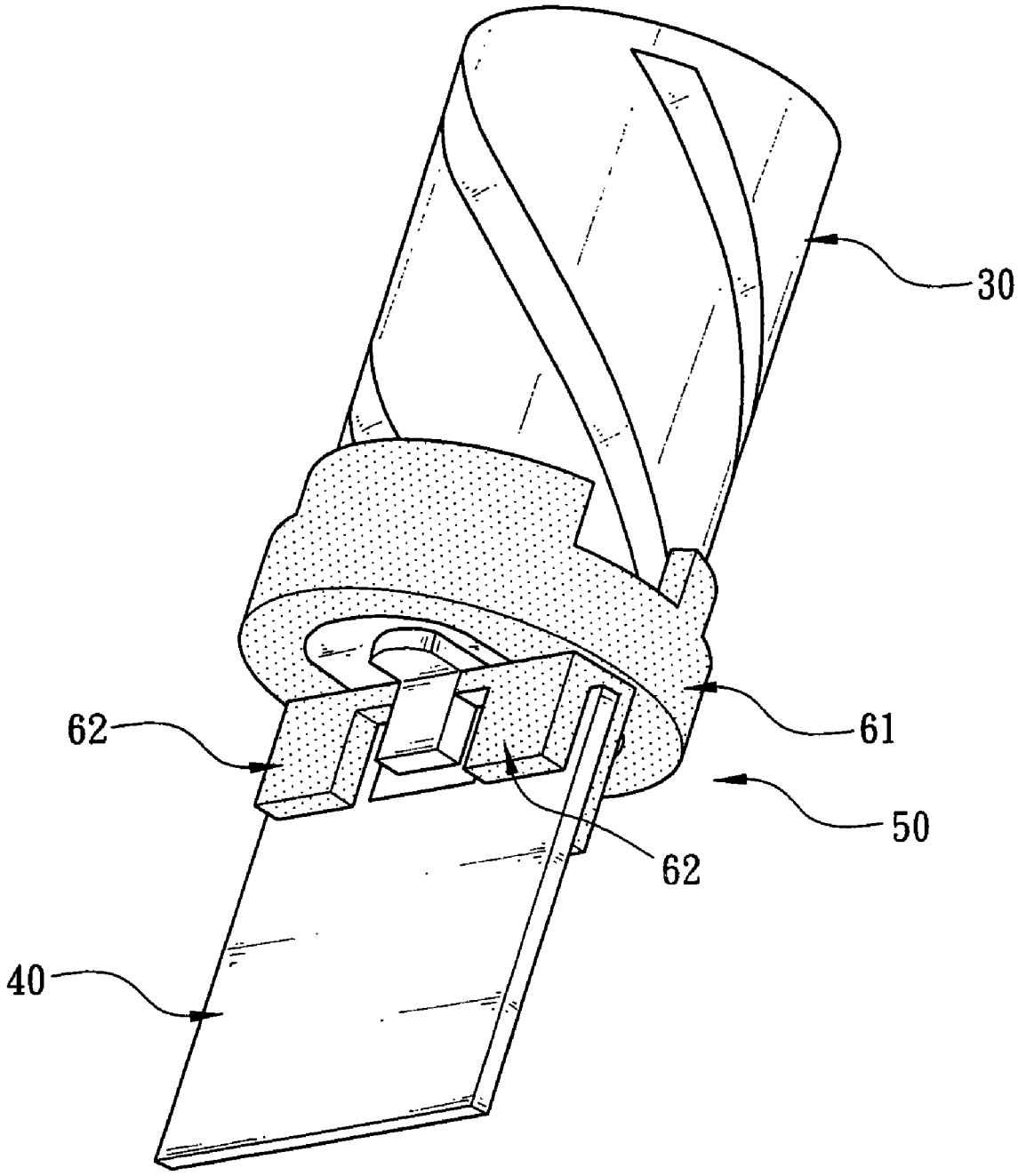
FIG. 4 is a schematic view of a quadri-filar helical antenna according to a preferred embodiment of the present invention.

Referring to FIG. 4 for another preferred embodiment of the present invention, a first fixing structure 61 and a second fixing structure 62 are formed by extending the insulating material 60 from both ends of the connecting element 50, wherein the first fixing structure 61 is fixed onto an end of the cylindrical body 30, and the second fixing structure 62 is clamped and fixed onto an edge of the circuit board 40, such that the cylindrical body 30 and the circuit board 40 can be connected more securely.

Figure 5A:
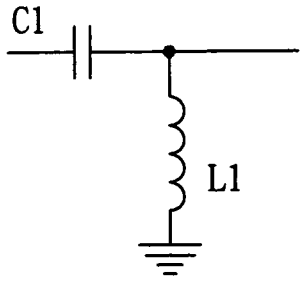
FIG. 5A~5F is schematic view of an impedance matching circuit according to the present invention.
Figure 5B:
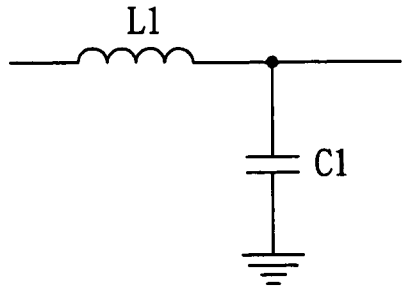
Figure 5C:
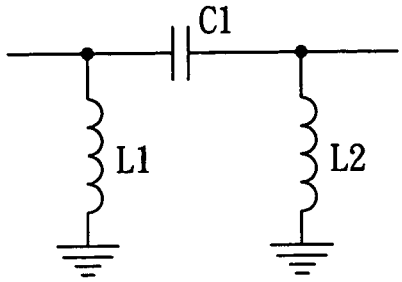
Figure 5D:
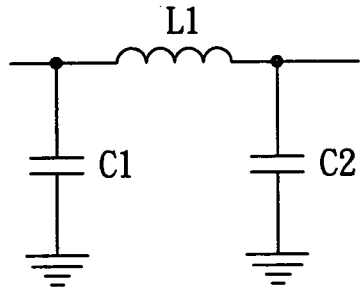
Figure 5E:
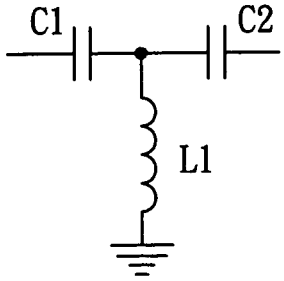
Figure 5F:
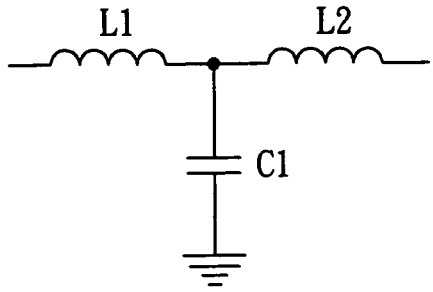

In the foregoing preferred embodiment of the present invention, the impedance matching circuit 42 on the circuit board 40 can be selected according to actual needs. For example, the impedance matching circuit could be an L section matching circuit as shown in FIGS. 5A and 5B, a π section matching circuit as shown in FIGS. 5C and 5D, a T section matching circuit as shown in FIGS. 5*e* and 5*f*, or a matching circuit of two or more multi-sections, wherein C1, C2, L1 and L2 respectively stand for the selected capacitors and inductors for the impedance matching according to actual needs. To verify the feasibility of the present invention, the inventor of the present invention based on the preferred embodiment as illustrated in FIGS. 2 and 3 to produce a cylindrical body 30 having a quadri-filar helical antenna and uses different impedance matching circuits 42 under the GPS resonant frequency to operate according to the following adjustments, so as to achieve the impedance matching between the antenna and the system.

Figure 6:
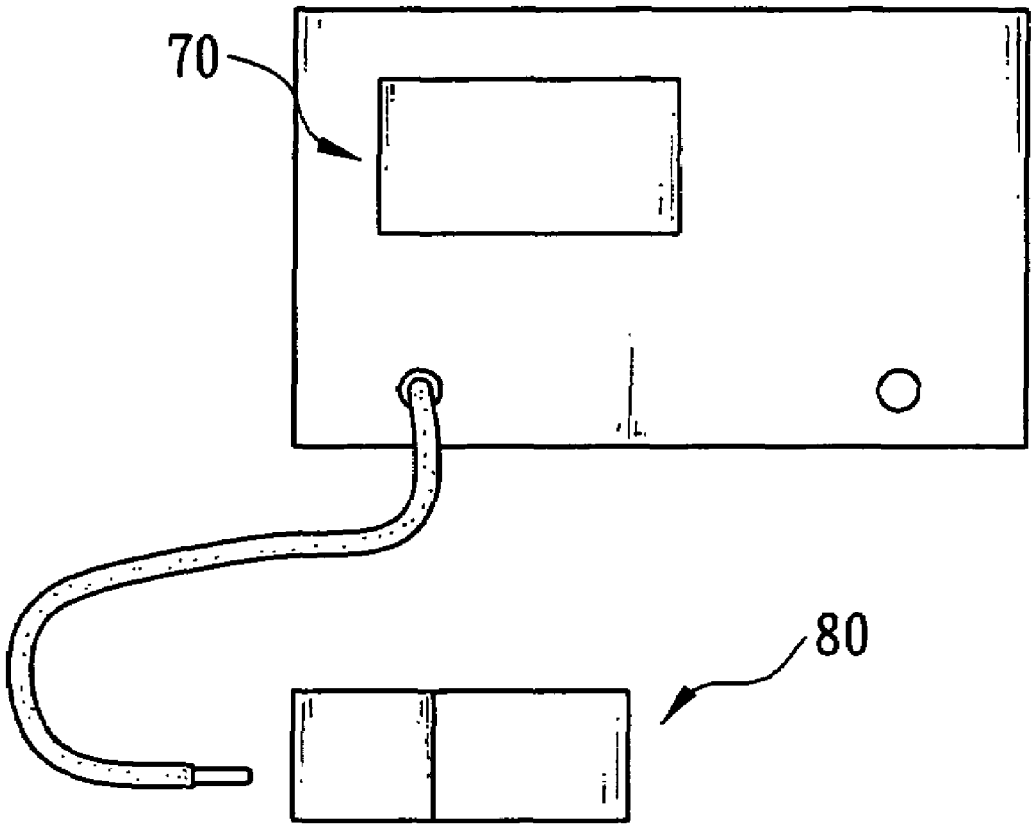
FIG. 6 is a schematic view of the testing the as depicted in FIG. 2.

(1) Referring to FIG. 6, a network analyzer 70 tests the cylindrical body 80 and measures an input impedance under the resonant frequency of the cylindrical body 80, and obtains the value of the output impedance after all transmission loss and phase difference are adjusted accurately.

Figure 7A:
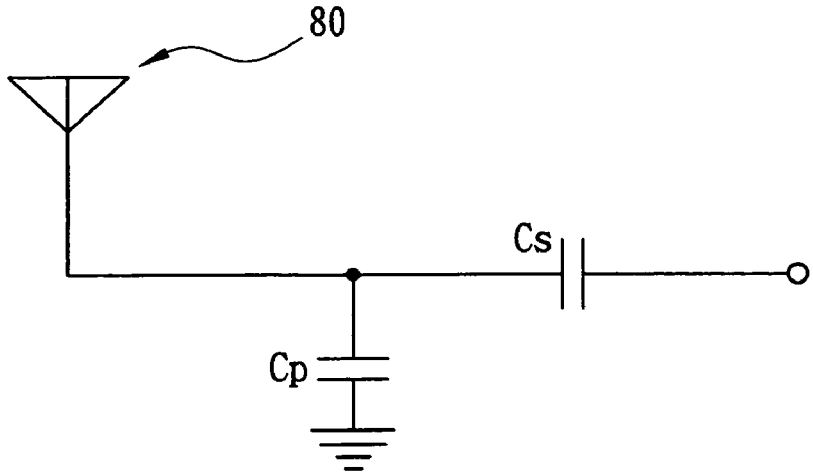
FIG. 7A is a schematic view of an equivalent circuit of a quadri-filar helical antenna of a first impedance matching circuit.
Figure 7B:
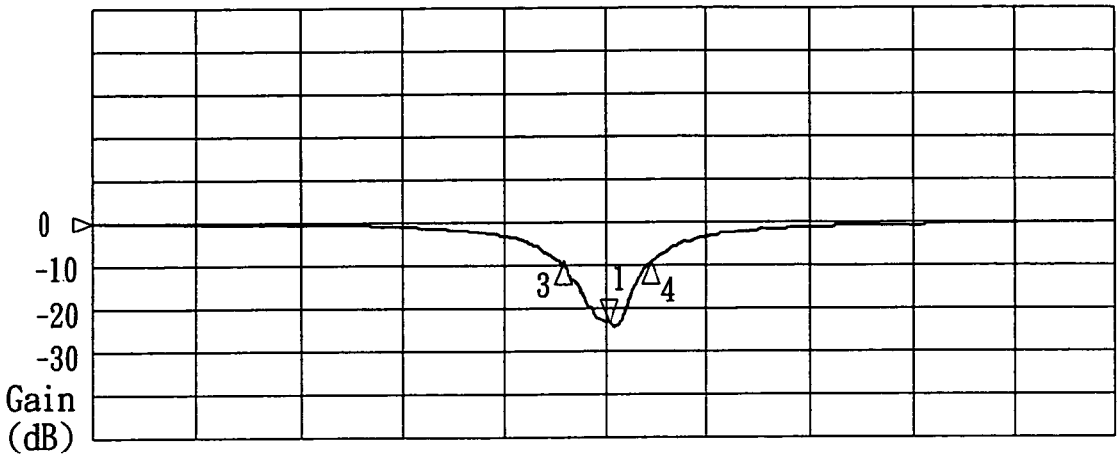
FIG. 7B is a schematic view of a testing result of a first kind of a quadri-filar helical antenna as depicted in FIG. 7A.
Figure 7B:
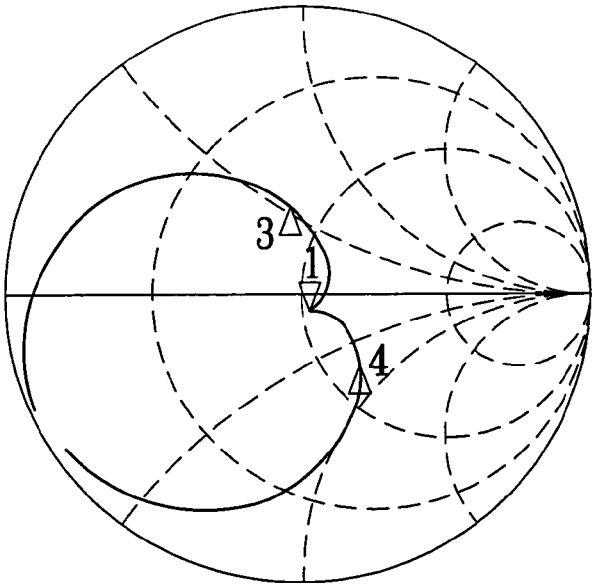

(2) According to the value of the measured input impedance, an impedance matching circuit is designed on a circuit board connected to the cylindrical body 80 to carry out an impedance matching conversion between the antenna and the system. In the actual testing procedure of the present invention, the following two impedance matching circuits are designed as needed:

(a) The first type of impedance matching circuit is an L section impedance matching circuit and its circuit diagram is shown in FIG. 7A. If the first type of impedance matching circuit is connected to the cylindrical body 80, the test result is shown in FIG. 7B. Under the resonant frequency of the GPS, the matching circuit can successfully reach the target matching of 50 ohms (Ω) as indicated by Point 1 in FIG. 7B. From Points 3 and 4 of FIG. 7B, it is known that when the return loss is −10 dB, the impedance matching bandwidth falls in the range of 1.566 GHz~1.584 GHz.

Figure 8A:
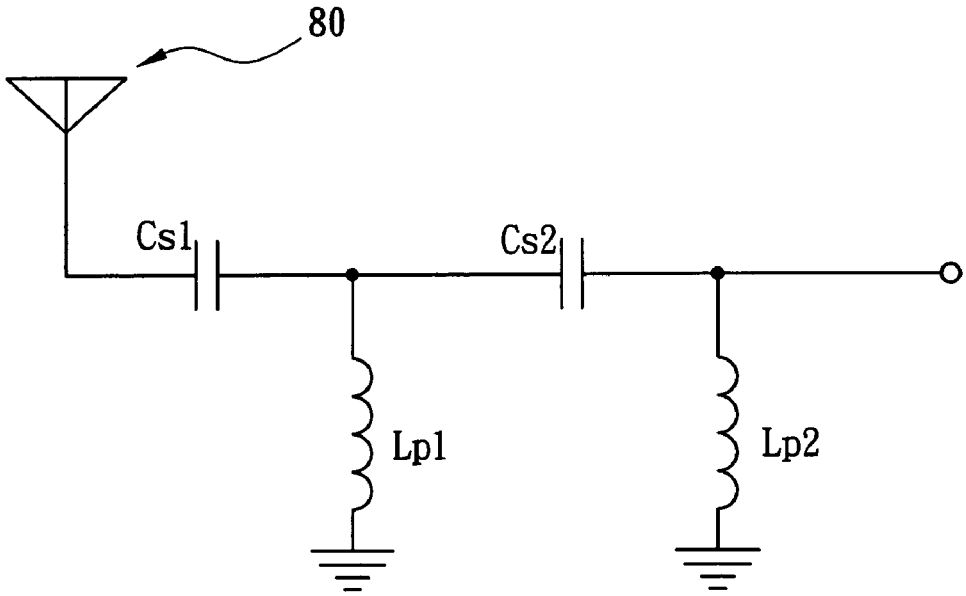
FIG. 8A is a schematic view of an equivalent circuit of a quadri-filar helical antenna of a second impedance matching circuit.
Figure 8B:
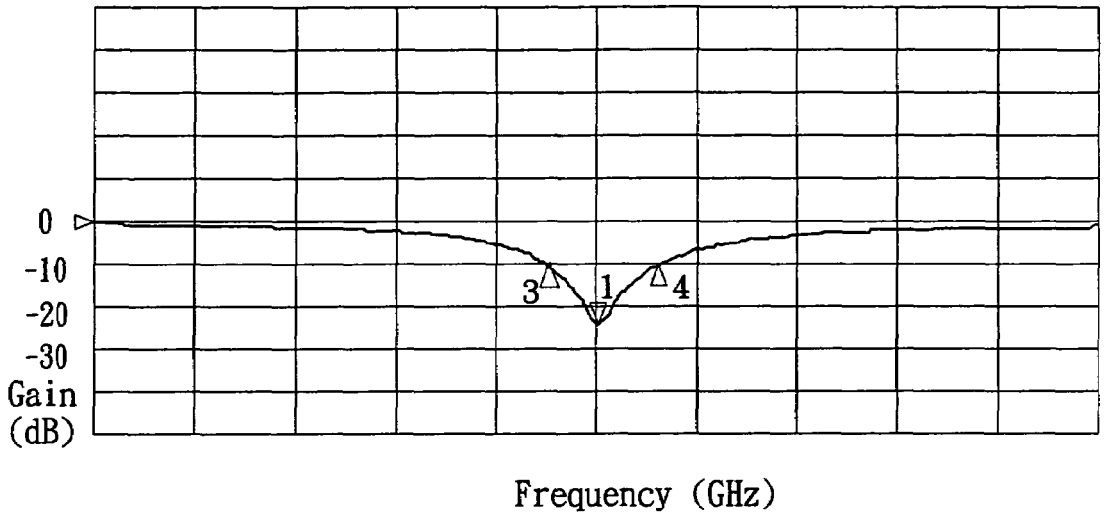
FIG. 8B is a schematic view of a testing result of a second kind of a quadri-filar helical antenna as depicted in FIG. 7A.
Figure 8B:
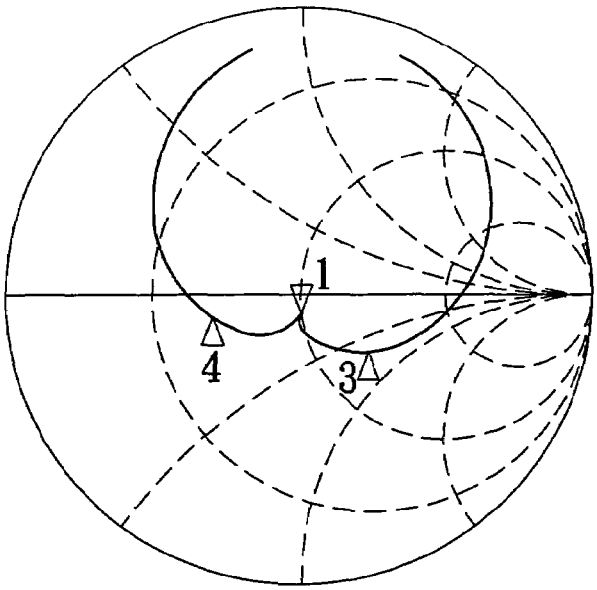

(b) The second type of impedance matching circuit is a dual-stage L section impedance matching circuit and its circuit diagram is shown in FIG. 8*a*. To have a larger impedance matching bandwidth, the second type of impedance matching circuit is connected to the cylindrical body 80. After the test is performed, the result is shown in FIG. 8C. Under the resonant frequency of the GPS, the matching circuit can successfully reach a target matching of 50 ohms (Ω) as indicated by Point 1 of FIG. 8B. From Points 3 and 4, it is known that the impedance matching bandwidth falls into the range of 1.565 GHz~1.587 GHz when the return loss is −10 dB. The impedance matching bandwidth of the second type of the impedance matching circuit is obviously boarder than that of the first type of the impedance matching circuit.

Further, it is worth to note that the quadri-filar helical antenna structure according to the foregoing preferred embodiment as shown in FIG. 2 comprises a plurality of radial metal plates 311, 312, 313, 314, and at least one radial metal plate 312, 313 extended in a helical form along a meandering course on an edge of the cylindrical body 30 and along the circumferential surface of the cylindrical body 30. Until the radial metal plates 312, 313 are extended to the edge of the other end of the cylindrical body 30, an electric length with odd multiples of a quarter of wavelength is precisely wound around the cylindrical body 30. Further, the quadri-filar helical antenna comprises a plurality of radial metal plates 311, 312, 313, 314, and at least one radial metal plate 311, 314 is extended in a linear course from an edge of the cylindrical body 30 along the circumferential surface of the cylindrical body 30 in a helical form to the other edge of the cylindrical body 30. Until the radial metal plates 311, 314 are extended to another edge of the cylindrical body 30, an electric length with odd multiples of a quarter of wavelength is precisely wound around the cylindrical body 30.

Therefore, the quadri-filar helical antenna structure of the present invention can omit the Balun and the feeder structure of a coaxial cable of the Leisten patent. The present invention not only effectively reduces the volume of the whole quadri-filar helical antenna structure and provides a simple structural design, but also directly attaches the radial metal plates onto the cylindrical body by silk printing, The present invention does not have to go through the complicated manufacturing processes of copper plating, exposure, etching and laser trimming to manufacture the required quadri-filar helical antenna structure, and thus greatly lowering the working hours, manpower and costs of the manufacture and achieving the objectives of designing and adjusting the impedance matching through the impedance matching circuit.

What is claimed is:

1. A coaxial cable free quadri-filar helical antenna structure, comprising: a cylindrical body, made of an dielectric material with a relative dielectric constant larger than 4; four radial metal plates, each having an end disposed at a distal surface of said cylindrical body and extended from the center of said cylindrical body along a radial direction to an edge of said cylindrical body, and then extended in a helical course along an axial direction on the circumferential surface of said cylindrical body to another edge of said cylindrical body, and the corresponding ends of every two adjacent radial metal plates on a distal surface of said cylindrical body being coupled to form two antenna structures; and a circuit board, fixed at a position proximate to a distal end of said cylindrical body and having a ground surface disposed at a side, and said ground surface being electrically coupled to a set of said antenna structures, and an impedance matching circuit disposed on another side, such that an end of said impedance matching circuit is electrically coupled to another set of said antenna structures, and another end of said impedance matching circuit is a signal feeder end of said antenna structures.

2. The antenna structure of claim 1, further comprising a connecting element for coupling said cylindrical body to said circuit board and electrically coupling said two sets of antenna structures on said cylindrical body separately and electrically coupled to said ground surface and said impedance matching circuit on said circuit board.

3. The antenna structure of claim 1, wherein said connecting element further comprises: an insulating material; two mutually insulated electric contact points, disposed at an end of said insulating material and soldered to be physically and electrically coupled to said two sets of antenna structures on a distal surface of said cylindrical body; and two other mutually insulated electric contact points, disposed at another end of said insulating material and soldered to be physically and electrically coupled to said ground surface and said impedance matching circuit on said circuit board; such that said two electric contact points and said other two electric contact points are electrically coupled by two corresponding independent courses.

4. The antenna structure of claim 3, wherein said connecting element further comprises: a first fixing structure, being formed by extending an end of said insulating material and fixed onto an end of said cylindrical body; and a second fixing structure, being formed by extending another end of said insulating material and clamped and fixed onto an edge of said circuit board.

5. The antenna structure of claims 1, wherein when at least one of said radial metal plates is extended in a meandering course from an edge of said cylindrical body along the circumferential surface of said cylindrical body and extended in a helical form to another edge of said cylindrical body, then an electrical length of odd multiples of a quarter wavelength of said cylindrical body is wound.

6. The antenna structure of claims 2, wherein when at least one of said radial metal plates is extended in a meandering course from an edge of said cylindrical body along the circumferential surface of said cylindrical body and extended in a helical form to another edge of said cylindrical body, then an electrical length of odd multiples of a quarter wavelength of said cylindrical body is wound.

7. The antenna structure of claims 3, wherein when at least one of said radial metal plates is extended in a meandering course from an edge of said cylindrical body along the circumferential surface of said cylindrical body and extended in a helical form to another edge of said cylindrical body, then an electrical length of odd multiples of a quarter wavelength of said cylindrical body is wound.

8. The antenna structure of claims 4, wherein when at least one of said radial metal plates is extended in a meandering course from an edge of said cylindrical body along the circumferential surface of said cylindrical body and extended in a helical form to another edge of said cylindrical body, then an electrical length of odd multiples of a quarter wavelength of said cylindrical body is wound.

9. The antenna structure of claims 1, wherein when at least one of said radial metal plates is extended in a linear course from an edge of said cylindrical body along the circumferential surface of said cylindrical body and extended in a helical form to another edge of said cylindrical body, then an electrical length of odd multiples of a quarter wavelength of said cylindrical body is wound.

10. The antenna structure of claims 2, wherein when at least one of said radial metal plates is extended in a linear course from an edge of said cylindrical body along the circumferential surface of said cylindrical body and extended in a helical form to another edge of said cylindrical body, then an electrical length of odd multiples of a quarter wavelength of said cylindrical body is wound.

11. The antenna structure of claims 3, wherein when at least one of said radial metal plates is extended in a linear course from an edge of said cylindrical body along the circumferential surface of said cylindrical body and extended in a helical form to another edge of said cylindrical body, then an electrical length of odd multiples of a quarter wavelength of said cylindrical body is wound.

12. The antenna structure of claims 4, wherein when at least one of said radial metal plates is extended in a linear course from an edge of said cylindrical body along the circumferential surface of said cylindrical body and extended in a helical form to another edge of said cylindrical body, then an electrical length of odd multiples of a quarter wavelength of said cylindrical body is wound.

13. The antenna structure of claims 1, wherein said impedance matching circuit is one reactive component with a sufficient transmission line, an L section matching circuit, a π section matching circuit, a T section matching circuit, or a matching circuit of dual-stage or multistage.

14. The antenna structure of claims 2, wherein said impedance matching circuit is one reactive component with a sufficient transmission line, an L section matching circuit, a π section matching circuit, a T section matching circuit, or a matching circuit of dual-stage or multistage.

15. The antenna structure of claims 3, wherein said impedance matching circuit is one reactive component with a sufficient transmission line, an L section matching circuit, a π section matching circuit, a T section matching circuit, or a matching circuit of dual-stage or multistage.

16. The antenna structure of claims 4, wherein said impedance matching circuit is one reactive component with a sufficient transmission line, an L section matching circuit, a π section matching circuit, a T section matching circuit, or a matching circuit of dual-stage or multistage.

17. The antenna structure of claims 1, wherein said dielectric material is a ceramic material.

18. The antenna structure of claims 2, wherein said dielectric material is a ceramic material.

19. The antenna structure of claims 3, wherein said dielectric material is a ceramic material.

20. The antenna structure of claims 4, wherein said dielectric material is a ceramic material.

21. The antenna structure of claims 1, wherein said dielectric material is a polymer material.

22. The antenna structure of claims 2, wherein said dielectric material is a polymer material.

23. The antenna structure of claims 3, wherein said dielectric material is a polymer material.

24. The antenna structure of claims 4, wherein said dielectric material is a polymer material.

* * * * *